US007185522B2

(12) United States Patent
Turley

(10) Patent No.: US 7,185,522 B2
(45) Date of Patent: Mar. 6, 2007

(54) SIDE SUPPORTED 6-HIGH ROLLING MILL

(75) Inventor: John W. Turley, Oxford, CT (US)

(73) Assignee: T. Sendzimir, Inc., Waterbury, CT (US)

( * ) Notice: Subject to any disclaimer, the term of this patent is extended or adjusted under 35 U.S.C. 154(b) by 63 days.

(21) Appl. No.: 11/125,801

(22) Filed: May 10, 2005

(65) Prior Publication Data

US 2006/0254335 A1 Nov. 16, 2006

(51) Int. Cl.
*B21B 13/14* (2006.01)
*B21B 27/10* (2006.01)

(52) U.S. Cl. ..... 72/201; 72/243.2

(58) Field of Classification Search ..... 72/201, 72/243.2, 243.4, 241.6
See application file for complete search history.

(56) References Cited

U.S. PATENT DOCUMENTS

| | | | | |
|---|---|---|---|---|
| 2,085,449 | A | | 6/1937 | Rohn |
| 2,169,711 | A | | 8/1939 | Sendzimir |
| 2,170,732 | A | | 8/1939 | Sendzimir |
| 2,187,250 | A | | 1/1940 | Sendzimir |
| 2,479,974 | A | | 8/1949 | Sendzimir |
| 2,566,679 | A | | 9/1951 | Sendzimir |
| 2,776,580 | A | | 1/1957 | Tack |
| 2,776,586 | A | | 1/1957 | Sendzimir |
| 2,907,235 | A | | 10/1959 | Murakami |
| 2,909,088 | A | * | 10/1959 | Volkhausen ..... 72/243.2 |
| 3,533,263 | A | * | 10/1970 | Klaus et al. ..... 72/243.2 |
| 4,059,002 | A | | 11/1977 | Rommen et al. |
| 4,197,731 | A | | 4/1980 | Verbickas et al. |
| 4,248,073 | A | | 2/1981 | Verbickas et al. |
| 4,270,377 | A | | 6/1981 | Verbickas et al. |
| 4,531,394 | A | | 7/1985 | Turley et al. |
| 4,552,008 | A | * | 11/1985 | Schlatter et al. ..... 72/201 |
| 4,598,566 | A | * | 7/1986 | Bald et al. ..... 72/243.2 |
| 4,671,091 | A | | 6/1987 | Atack et al. |
| 4,918,965 | A | * | 4/1990 | Kobayashi et al. ..... 72/243.2 |
| 5,197,179 | A | | 3/1993 | Sendzimir et al. |

FOREIGN PATENT DOCUMENTS

| | | |
|---|---|---|
| DE | 538 365 C | 11/1931 |
| DE | 199 24 860 A1 | 12/1999 |
| EP | 0 706 840 A | 6/1987 |
| EP | 0 411 615 A | 2/1991 |

* cited by examiner

*Primary Examiner*—Dmitry Suhol
(74) *Attorney, Agent, or Firm*—Frost Brown Todd LLC

(57) ABSTRACT

A 6-high rolling mill has work rolls which have offsets, relative to the intermediate rolls, such that during operation there is a net horizontal force acting to urge the work rolls into engagement with the support rolls whereby substantially all horizontal support of the work rolls is provided by the support rolls. Support pads are located proximal the rolls' side faces, without exerting any substantial force on the work rolls during operation.

14 Claims, 4 Drawing Sheets

SIDE SUPPORTED 6-HIGH ROLLING MILL

TECHNICAL FIELD

The invention relates to a 6-high cold rolling mill and more particularly to a non-reversing mill, rolling metal strip in a fixed direction through the mill.

BACKGROUND ART

The invention relates to a 6-high cold rolling mills having side supported work rolls of the kind described generally in U.S. Pat. Nos. 4,270,370 and 4,531,394. The improvements described herein are of particular use when the rolling mill is part of a continuous line described generally in U.S. Pat. No. 5,197,179 or is of the kind described in U.S. Pat. No. 6,041,036 or when the mill is supplied as a tandem mill, incorporating several mill stands rolling metal strip in a fixed direction.

It is well known in the art that during rolling, drive torque must be delivered to the work rolls. Since the work rolls in such mills are free floating and thus are not driven, the torque must be delivered in the form of a tangential force which acts in a horizontal direction at the contact line between each work roll and its main support roll (the intermediate roll). The same is true regardless of whether the intermediate rolls or the back-up rolls are driven. This force always pushes each work roll towards the entry side of the mill and the reaction force pushes the adjacent intermediate roll towards the exit side of the mill.

These mills are supplied with a side support structure at each side of each work roll, each cluster comprising one side support roll which is nested between two rows of side support caster bearings, each row mounted upon a shaft with the shaft being supported by saddles mounted on a cluster arm, with the cluster arm being supported in its turn by a side support beam adjustably mounted between drive and operator side mill housings.

This structure is suitable for a reversing mill where, depending upon rolling direction either the left side or the right side support structures may be loaded by the tangential torque forces. However, for a non-reversing mill, it might be thought that there would be no need for side support structures at the exit side of the mill since such structures would not be subjected to load during rolling. In fact, the exit side support structure is needed for several reasons. Firstly, it is needed to ensure that the work rolls can be set in the correct position abutting the entry side support roll before rolling commences. Secondly, it is needed because sometimes in order to reduce the horizontal forces acting on the entry side support caster bearings and on the intermediate roll neck bearings, it is desirable to operate such mills with the work rolls off-set towards the exit side so that a horizontal component of the roll separating force will develop which will act to push the work rolls towards the exit side and the intermediate rolls towards the entry side, thus off-setting the torque reaction forces. Under some conditions, for example when initially screwing down to set the roll gap with the mill stationary, the torque reaction forces will be zero, but the horizontal component of roll separating force will be non-zero and there will be a net force acting to push the work rolls towards the exit side, thus necessitating exit side support structures.

To control the flatness of the strip rolled on such a mill, two methods exist in the art. These are axial shifting of the intermediate rolls, and bending of the intermediate rolls. These methods are quite effective for controlling second order flatness defects such as center-buckle and wavy edge, but are not able to correct more local defects such as non-symmetrical quarter buckle and localized strip buckle.

By contrast, non side-supported mills such as 4hi mills and conventional 6-high mills not only incorporate work roll and intermediate roll bending, and (6-high only) intermediate roll shifting, but also incorporate multi-zone work roll cooling sprays which are able to achieve localized correction of flatness defects by controlling work roll temperature distribution. At each zone there are usually 3 spray nozzles with respective flow areas in the ration 1:2:4, each nozzle being controlled by solenoid valve. Depending upon which solenoid valves are on, the flow to each zone can be adjusted with a turn-down ratio of 1:7. As the work roll diameter on such mills is relatively large, it's easily possible to fit such a coolant spray system into the mill structure adjacent to the work rolls.

On prior art side supported 6-high mills, not only is the work roll diameter relatively small, but the space at each side of the work rolls is filled with the side support structure and there is no room to mount work roll cooling sprays.

The objective of this invention is to provide for a side supported 6-high mill a novel side support structure, which will incorporate multi-zone work roll cooling sprays.

BRIEF DESCRIPTION OF THE DRAWINGS

In the accompanying drawings incorporated in and forming a part of the specification illustrate several aspects of the present invention, and together with the description serve to explain the principles of the invention. In the drawings.

Figure 1:
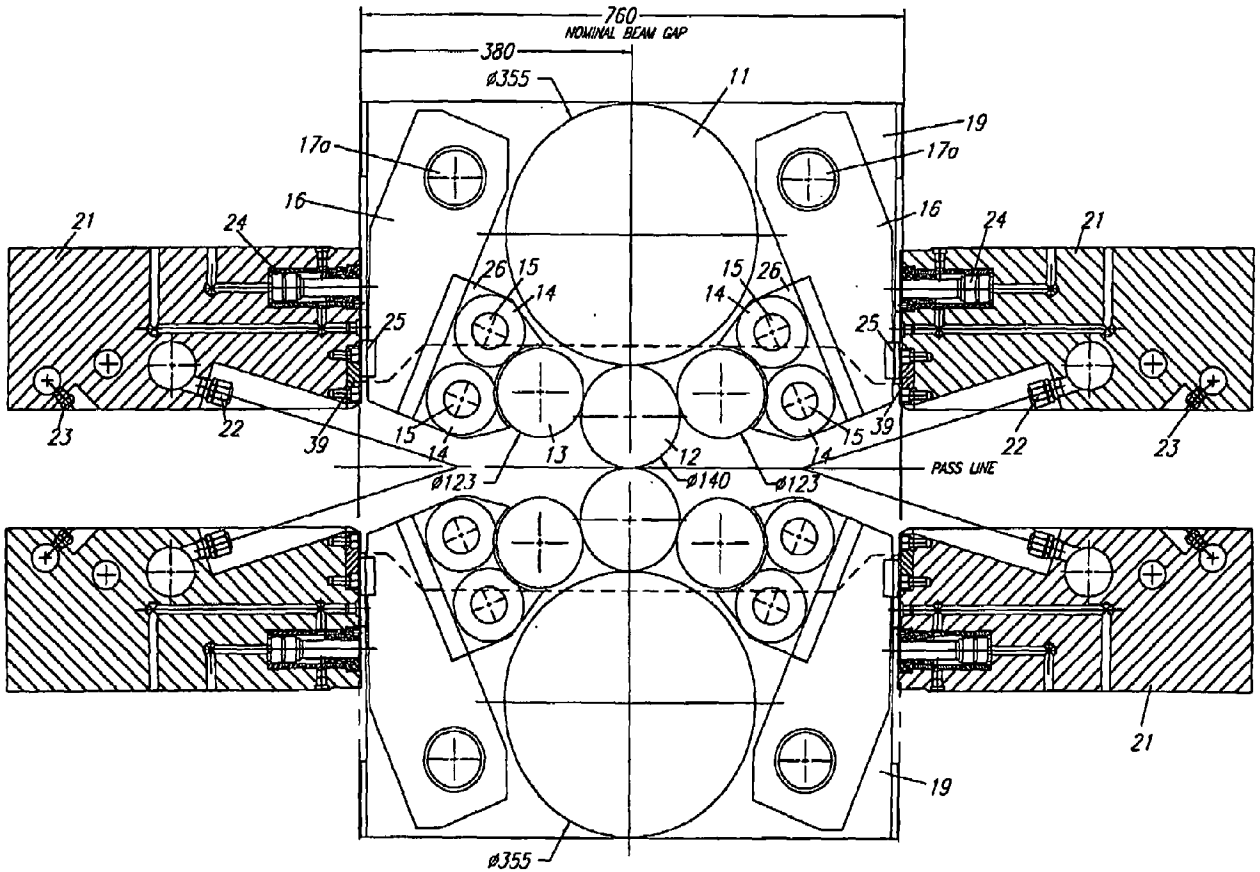
FIGURE 1. PRIOR ART
FIG. 1 is a partial cross section of a side supported 6-high mill according to the prior art viewed from the operator side.

Reference will now be made in detail to an embodiment of the invention, an example of which is illustrated in the accompanying drawings.

DETAILED DESCRIPTION OF AN EMBODIMENT OF THE INVENTION

In the following description of an exemplary embodiment of the present invention, like numerals indicate like objects throughout the drawings. In the drawings, only work rolls, intermediate rolls and side support structures are shown. The back-up rolls and back-up roll chocks, mill housings and other mill structures are according to the prior art.

The prior art side supported 6-high mill shown in FIG. 1 includes intermediate rolls 11, bearing mounted in chocks 19, free floating work rolls 12, each work roll being supported at each side by side support roll 13, itself supported by caster bearings 14 mounted on shafts 15 supported by saddles 26 mounted on cluster arm 16. Each cluster arm 16 is mounted on shaft 17*a*, which extends between operator side and drive side intermediate roll chocks 19 and is pivot mounted between the chocks. Any horizontal force transmitted to cluster arm 16 passes through spacer bar 25 to liner 39 attached to side support beam 21 which is adjustably fixed to drive and operator side housings and thus supports the transmitted force.

Each beam 21 incorporates spray nozzles 22 and 23 to cool the strip and cool and lubricate the roll bite and the work rolls and hydraulic pre-load cylinders 24 which are used to pre-load the exit side support clusters against the work rolls thus ensuring that the work rolls are properly set in contact with the entry side support rolls before the screwdown is closed prior to the start of rolling. Note that the roll sizes given are typical for a mill of this type rolling 1300 or 1600 mm wide strip. Work roll diameter (140 mm) is much smaller than that of a 4-high or 6-high mill rolling strip of comparable width which would be 450 mm or greater.

Figure 2:
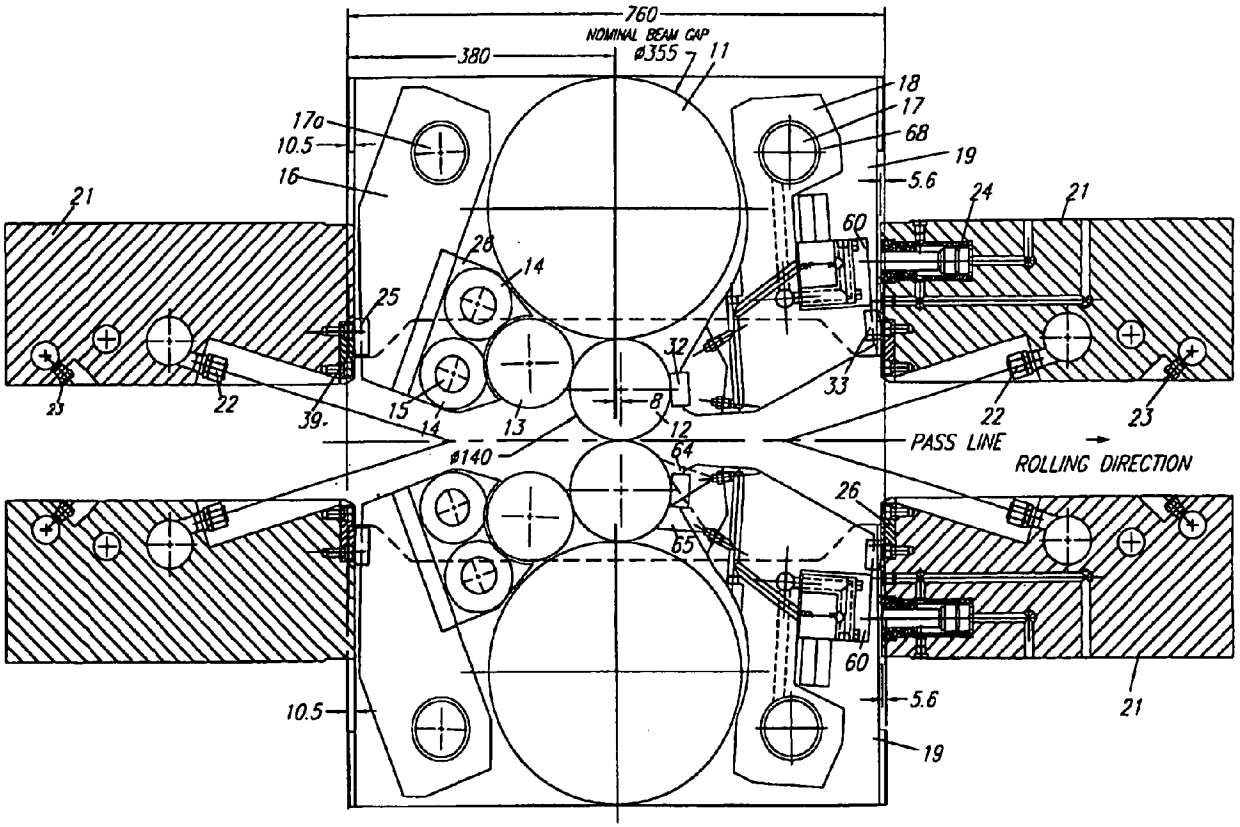
FIG. 2 is a partial cross section of a side supported 6-high mill constructed according to the teachings of the present, invention showing the new upper and lower exit side support arm assemblies, viewed from the operator side.

FIG. 2 illustrates a side supported 6-high mill constructed according to the teachings of the present invention. The mill includes exit side support cluster arms which incorporate no rolls or bearings, but which incorporate support pads 32 which could be made of any suitable material such as phosphor bronze or a graphite reinforced self-lubricating material such as "Wear Comp" manufactured by Hycomp Co. of Cleveland, Ohio. Since the upper and lower exit side support cluster arms are similarly constructed, only the upper exit side support cluster arm will be described in detail, it being understood that the description applies also to the lower exit side support cluster arm configuration.

Exit side support cluster arm 18 is mounted on pivot shaft 17, similar to entry side cluster arm 16 as can be seen in FIG. 2. In FIG. 2, the rolling direction is left-to-right and it can be seen that preload cylinders 24 may be omitted from entry side support beams 21 because the depicted mill rolls left-to-right only. Other features of side support beams 21 are unchanged.

Figure 3:
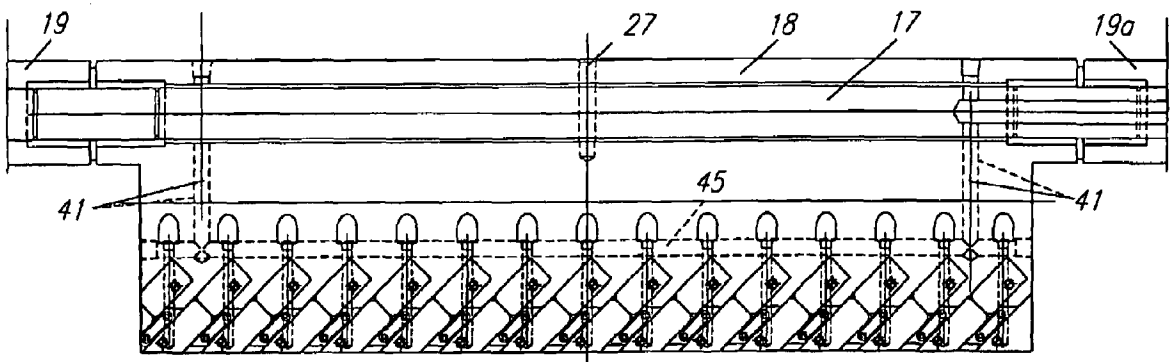
FIG. 3 is a partial cross sectional view of the upper exit side support arm assembly of FIG. 2 viewed from the entry side.

FIG. 3 shows upper exit side support cluster arm 18 viewed from the entry side (the side facing the work roll) and pivot shaft 17 spanning between drive side intermediate roll chock 19 and operator side intermediate roll chock 19*a*.

Figure 4:
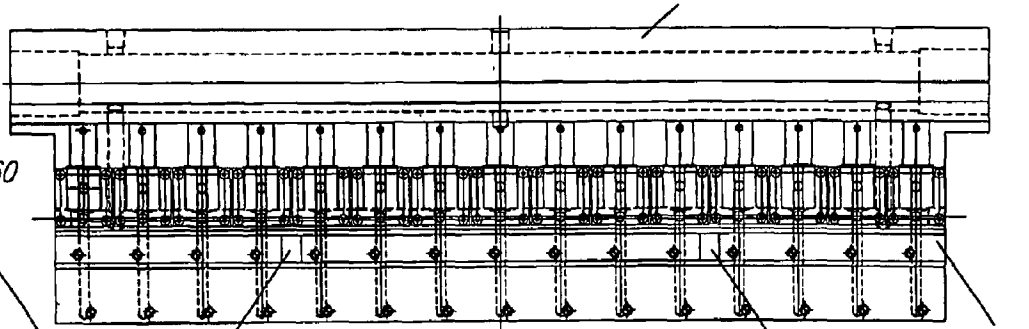
FIG. 4 is a view of the upper exit side support arm assembly of FIG. 2 viewed from the exit side.
Figure 4A:
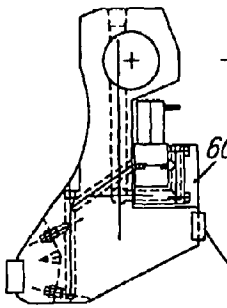
FIG. 4A is an end view of FIG. 4.

FIG. 4 shows the upper exit side support assembly viewed from the exit side (the side facing away from the work roll). FIG. 4*a* shows an end view of the upper exit side support assembly.

Figure 7:
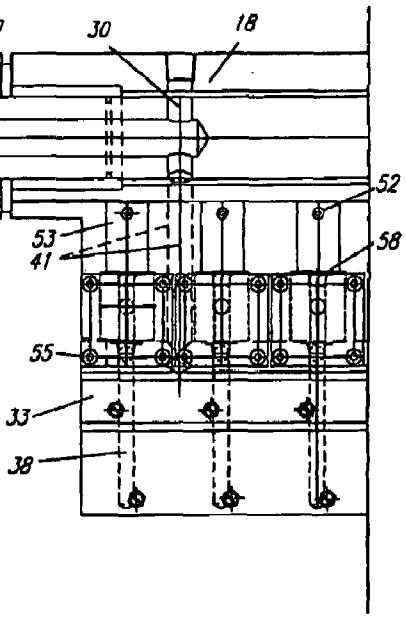
FIG. 7 is an enlarged partial view of the assembly shown in FIG. 4.
Figure 5:
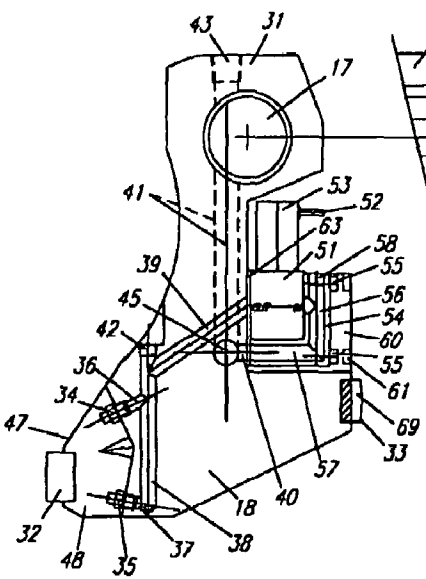
FIG. 5 is an enlarged cross section corresponding to the view of the exit side support arm assembly shown in FIG. 2.
Figure 6:
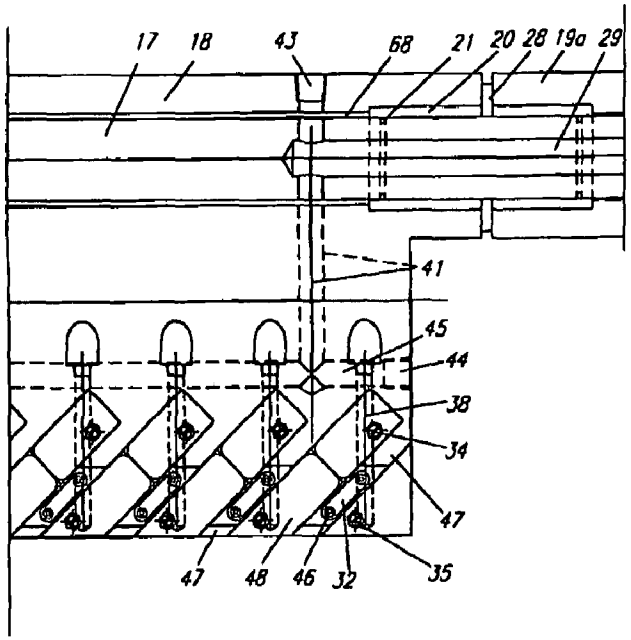
FIG. 6 is an enlarged partial view of the assembly shown in FIG. 3.

Referring to FIGS. 5, 6 and 7, which show enlarged partial views of exit side support cluster arm 18 of FIGS. 2, 3, 4 and 4*a* respectively, coolant oil is delivered to exit side support cluster arm 18 via axial hole 29 in pivot shaft 17. (On the entry side, axial hole 29 of shaft 17*a* delivers lubricating oil to cluster arm 16 for lubrication of side support bearings 14). This oil flows through radial hole 30 in pivot shaft 17 to annular gap 68 between pivot shaft 17 and arm 18. The oil flows through two vertical holes 41, which may be located adjacent the ends of arm 18, to cross-hole 45 which may extend the length of arm 18. Plugs 43 and 44 may be used to plug the open ends of holes 41 and 45 respectively.

As can be seen from FIG. 3 or FIG. 4, in the embodiment depicted, arm 18 may be divided into any suitable number of zones, with fifteen zones being shown in the depicted embodiment. At each zone, as shown in FIG. 5, coolant oil flows from cross-hole 45 through holes 57 and 56 to the "IN" port of proportional valve 51 and from the "OUT" port of valve 51 to hole 39 thence to hole 38, thence through holes 36 and 37 to vee-jet nozzles 34 and 35 which spray the oil on to the entire adjacent side face of work roll 12 as it rotates. The open end of hole 38 is closed using plug 42. By controlling the opening of proportional valve 51, by remotely controlling the electric current supplied through cable 52 to coil 53 of proportional valve 51, the rate of flow of coolant oil sprayed on to the work roll at this zone can be adjusted. In the embodiment shown the width of each zone is 90 mm and thus 15×90 or 1350 mm of the work roll face can be selectively cooled. The coolant control system may form part of an Automatic Flatness Control (AFC) system and the coolant spray flow distribution across these zones would thereby be adjusted according to flatness deviations measured by a shapemeter measuring tension distribution across the strip leaving the mill, according to prior art.

Referring to FIGS. 5 and 6, it can be seen that a plurality of recesses 48, also referred to as slots, may be formed on arm 18. Slots 48 are shown in the embodiment depicted as being at an angle of 45 degrees to the longitudinal axis of arm 18, although slots 48 may be disposed at any suitable angle. The angle enables ribs 47, on which pads 32 are disposed, to be suitably configured while still ensuring that the "vee" shaped jets (64 and 65 as shown in FIG. 2) coming from vee-jet nozzles 34 and 35 overlap properly and may cover the entire surface of work roll 12 as it rotates. This is desirable to ensure uniform cooling of work roll 12 when all the proportional valves are wide open.

Support pads 32 may be mounted in any suitable manner. As shown in the embodiment depicted, portions of support pads 32 may extend into recesses formed in ribs 47, providing strength, and may be held in place using any suitable fastener, such as recessed socket head cap screws 46. Note that the orientation of the vee jets in nozzles 34 and 35 are depicted as being set in line with slots 48 (i.e. parallel to ribs 47) to ensure that the spray oil jets do not impinge on each other, interfering with the flow, or on ribs 47, but flow in an unobstructed path to the work roll surface.

Spacer bar 33 on each exit side support cluster arm 18 is used to transmit any force to exit side support beam 21 as shown in FIG. 2. Bushings 20 and thrust washers 28 are used for radial and axial location of arm 18 and O-rings 21 are used to prevent oil leakage similarly to the prior art technique used on entry side cluster arms.

Valve 51 may be of any suitable configuration, such as a manifold mounted proportional valve suitable for operation with oil at typical coolant pressures in the range 0–10 bar (0–150 psi). In the embodiment depicted, valve 51 is of the line mounted type, which includes entry and exit ports on opposite sides of the valve body, mounted on the manifold formed by the vertical face of arm 18 by using "L" block 54 and soft gasket 63. Any suitable type and quantity of fasteners may be used, such as four cap screws 55, to clamp "L" block 54 and valve 51 against arm 18 via gasket 63 connecting the "OUT" port of valve 51 to hole 39 and the "IN" block of valve 51 via holes 56 and 57 in the "L" block to hole 40 in the arm 18. The open end of hole 56 is closed using plug 58.

At suitable locations (two in the depicted embodiment) along the length of arm 18, where preload cylinders 24 are located in the adjacent side support beam 21, blocks 60 may be provided which the pistons of preload cylinders 24 push against when these preload cylinders are actuated. Any suitable type and quantity of fasteners may be used at these locations to retain blocks 60. In the embodiment depicted, cap screws 61 are used in place of cap screws 55, and via block 60, clamp "L" block 54 and valve 51 against arm 18 via gasket 63. The outer surfaces of blocks 60 are shown flush with the outermost surface of arm 18, and spacer bar 33 may be provided with slots 69, as shown in FIG. 5, in line with the blocks 60, the bottom surfaces of slots 69 also being flush, so that if the intermediate roll chocks are raised while the piston rods of preload cylinders 24 are extended, the piston rods will slide freely over these surfaces and will not be damaged.

From FIG. 2 it can be seen that the centers of the upper and lower work rolls 12 are offset 8 mm towards the exit side of the mill which has the effect of reducing the net horizontal force on work rolls 12 because the horizontal component of the roll separating force (this component is induced by the offset) which acts to push each work roll 12 towards the exit side (right side in FIG. 2) counteracts the tangential torque force which acts to push each work roll 12 towards the entry side (left side in FIG. 2). Since side support beams 21 are adjustable in the left-to-right direction, they can be adjusted to set any desirable work roll offset. In practice, the horizontal component of the roll separating force is proportional to the offset and the offset may be set to such a value that the tangential torque force on each work roll is not completely counter-acted so that there is always a net horizontal force acting to push work roll 12 towards the entry side so work roll 12 can be supported by the entry side support structure comprising side support roll 13, side support bearings 14, shafts 15, saddles 26, cluster arm 16, spacer 25, liner 29 and entry side beam 21. Thus there is never any substantial force acting on pad 32 during rolling and therefore no wear. However, pad 32 and the remaining exit side support structure of arm 18, spacer bar 33, liner 39 and exit side beam 21 are in place to ensure that work roll 12 remains in the correct position under emergency conditions or when the rolls are opened or when the mill is closed by operating the screw-down when the mill is stationary. In the latter case, the full horizontal component of roll separating force will develop acting to push the work roll towards the exit side against pad 32 but because the mill is stationary no wear of pad 32 will take place.

In general, for a mill with rolls having dimensions shown in FIG. 2, a work roll offset of 5 mm should generally be sufficient to reduce the maximum net horizontal force acting on each work roll 12 (and reacting on each intermediate roll) by about 66–75%, which should be sufficient reduction to increase the life of side support bearings 14 and roll neck bearings of intermediate rolls 11 by a factor of ten or higher.

In another embodiment of the invention (not shown) the positions of cluster arms 16 and side support arms 18 shown are switched from that shown in FIG. 2, so that cluster arms 16 are installed on the exit side and side support arms 18 are installed on the entry side. With this arrangement, the design objective is to ensure that the net horizontal force on each work roll during rolling always acts towards the exit side, so that it can be supported by the side support rolls 13. This means that the horizontal component of separating force must always exceed the tangential torque force. To achieve this, the work roll must be offset by a greater amount towards the exit side than in the embodiment shown in FIG. 2, particularly when rolling thick relatively soft materials where the torque is relatively high and the roll separating force relatively low. To permit such rolling, the work roll offset may need to be as high as 10–12 mm for the roll dimensions shown in FIG. 2. Note that in this embodiment, preload cylinders 24 would be located in the entry side support beams rather than in the exit side support beams shown in FIG. 2.

The invention has been described herein by way of example and some modifications are permissible without departing from the spirit of the invention. For example, as described, thirty work roll spray nozzles are shown divided into fifteen zones, each zone including two nozzles and one proportional valve. It is within the scope of this invention to use any suitable number of zones and any suitable number of nozzles in the zones. For example, ten zones may be used, with each zone including three nozzles and one proportional valve, or thirty two nozzles may be used divided into eight zones each having four nozzles and one proportional valve. It is even possible if a sufficiently small proportional valve is available to have thirty zones with each zone including one nozzle and one proportional valve. Similarly, the proportional valve may be a classic proportional valve where the valve opening or flow is proportional to the direct current delivered to its coil. Or it may be a solenoid valve operated in a pulse width modulated mode to provide an average valve opening proportional to the average current. The essential feature is that the valve can be electrically operated by a remote electrical source, so that the average valve opening and flow will each be a direct function (normally closed type valve) or an inverse function (normally open type valve) of average current delivered to the valve.

In summary, numerous benefits have been described which result from employing the concepts of the invention. The foregoing description of one or more embodiments of the invention has been presented for purposes of illustration and description. It is not intended to be exhaustive or to limit the invention to the precise form disclosed. Obvious modifications or variations are possible in light of the above teachings. The one or more embodiments were chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

What is claimed:

1. A 6-high one way rolling mill stand for processing a strip, said mill stand having an entry side where the strip enters the mill stand, and an exit side where the strip exits the mill stand, a pair of intermediate rolls and a pair of side supported free floating work rolls between which said strip passes, each work roll of said work rolls including an entry side face and an exit side face, each said work roll having an associated entry side support structure comprising a support roll disposed on said entry side, said support roll configured to engage said entry side face of said work roll during operation, each said work roll also including an associated exit side support structure comprising at least one support pad, said exit side support structure being configured to maintain said at least one support pad proximal the exit side face of said work roll during operation, said at least one support pad not exerting any substantial force on said work roll during operation.

2. The 6-high rolling mill stand as claimed in claim 1, wherein each of said intermediate rolls is disposed between drive side and operator side intermediate roll chocks, and each said entry side support structure comprises a cluster arm, said cluster arm being pivotally supported on a shaft extending between said drive side and operator side intermediate roll chocks, said cluster arm supporting a plurality of side support bearings, said support roll being supported by said plurality of side support bearings.

3. The 6-high rolling mill stand as claimed in claim 1, wherein said mill stand comprises drive side and operator side intermediate roll chocks, said intermediate rolls are respectively disposed between said drive side and operator side intermediate roll chocks, and each said exit side support structure includes a shaft extending between said drive side and operator side intermediate roll chocks and includes a support arm pivotally supported on said shaft, and at least one of said at least one support pad is supported by said support arm.

4. The 6-high rolling mill stand as claimed in claim 1, wherein each said exit side support structure includes a plurality of coolant spray nozzles disposed so as to spray coolant onto substantially the entire exit side face of each work roll adjacent said at least one support pad.

5. The 6-high rolling mill stand as claimed in claim 4, wherein said mill stand comprises a plurality of zones, each of said zones includes one or more of said plurality of nozzles and a proportional valve configured to enable controlled flow of coolant to said one or more of said plurality of nozzles within said zone.

6. The 6-high rolling mill stand as claimed in claim 5, wherein each said proportional valve is controlled remotely.

7. The 6 high rolling mill stand as claimed in claim 5, wherein said proportional valve is mounted upon said side support structure.

8. A 6-high one way rolling mill stand for processing a strip, said mill stand having an entry side where the strip enters the mill stand, and an exit side where the strip exits the mill stand, a pair of intermediate rolls and a pair of side supported free floating work rolls between which said strip passes, each work roll of said work rolls including an entry side face and an exit side face, each said work roll having an associated exit side support structure comprising a support roll disposed on said exit side, said support roll configured to engage said exit side face of said work roll during operation, each said work roll being offset to said exit side relative to said intermediate rolls by an offset distance, each said work roll also including an associated entry side support structure comprising at least one support pad, said entry side support structure being configured to maintain said at least one support pad proximal the entry side face of said work roll during operation, said at least one support pad not exerting any substantial force on said work roll during operation.

9. The 6-high rolling mill stand as claimed in claim 8, wherein each of said intermediate rolls is disposed between drive side and operator side intermediate roll chocks, and each said exit side support structure comprises a (cluster arm, said cluster arm being pivotally supported on a shaft extending between said drive side and operator side intermediate roll chocks, said cluster arm supporting a plurality of side support bearings, said support roll being supported by said plurality of side support bearings.

10. The 6-high rolling mill stand as claimed in claim 8, wherein said mill stand comprises drive side and operator side intermediate roll chocks, said intermediate rolls are respectively disposed between said drive side and operator side intermediate roll chocks, and each said entry side support structure includes a shaft extending between said drive side and operator side intermediate roll chocks and includes a support arm pivotally supported on said shaft, and at least one of said at least one support pad is supported by said support arm.

11. The 6-high rolling mill stand as claimed in claim 8 wherein each said entry side support structure includes a plurality of coolant spray nozzles disposed so as to spray coolant onto substantially the entire entry side face of each work roll adjacent said at least one support pad.

12. The 6-high rolling mill stand as claimed in claim 11, wherein said mill stand comprises a plurality of zones, each of said zones including one or more of said plurality of nozzles and a proportional valve configured to enable controlled flow of coolant to said one or more of said plurality of nozzles within said zone.

13. The 6-high rolling mill stand as claimed in claim 12, wherein each said proportional valve is controlled remotely.

14. The 6 high rolling mill stand as claimed in claim 12, wherein said proportional valve is mounted upon said side support structure.

* * * * *